US012414637B2

(12) United States Patent
Ko

(10) Patent No.: US 12,414,637 B2
(45) Date of Patent: Sep. 16, 2025

(54) PNEUMATIC POCKET AND APPLICATION THEREOF

(71) Applicant: Fu-Chung Ko, Taichung (TW)

(72) Inventor: Fu-Chung Ko, Taichung (TW)

( * ) Notice: Subject to any disclaimer, the term of this patent is extended or adjusted under 35 U.S.C. 154(b) by 829 days.

(21) Appl. No.: 17/718,243

(22) Filed: Apr. 11, 2022

(65) Prior Publication Data

US 2023/0080080 A1 Mar. 16, 2023

(51) Int. Cl.
*A47C 27/10* (2006.01)
*A47C 27/08* (2006.01)

(52) U.S. Cl.
CPC ..... *A47C 27/10* (2013.01); *A47C 27/081* (2013.01)

(58) Field of Classification Search
CPC ..... A47C 27/06; A47C 27/056; A47C 27/081; A47C 27/084; A47C 27/10; A47C 7/025; A47C 7/14; A47C 7/142; A47C 7/144; B60N 2/914
USPC ..... 5/655.3, 260
See application file for complete search history.

(56) References Cited

U.S. PATENT DOCUMENTS 4,194,255 A * 3/1980 Poppe ..... A47C 27/065 428/116
7,000,277 B2 * 2/2006 Torres Cervera .... A47C 27/144 5/719
7,571,504 B2 * 8/2009 Kuo ..... A47C 27/15 5/724
D683,993 S * 6/2013 Malkiewicz ..... D6/606
8,904,584 B2 * 12/2014 Sugano ..... B29D 22/00 5/652
9,706,851 B2 * 7/2017 Malkiewicz ..... A47C 21/046
10,799,032 B2 * 10/2020 Kang ..... A47C 27/084
10,986,936 B2 * 4/2021 Dahl ..... A47C 27/08
12,239,239 B2 * 3/2025 Mallette ..... A47C 7/144
2007/0147956 A1 * 6/2007 Spingler ..... F16F 7/125 404/6
2010/0218318 A1 * 9/2010 Steppat ..... A47C 27/20 267/142
2015/0072103 A1 * 3/2015 Tresso ..... B32B 3/16 428/116
2019/0000247 A1 * 1/2019 Ko ..... B60N 2/7094

* cited by examiner

*Primary Examiner* — David R Hare
(74) *Attorney, Agent, or Firm* — Ying-Ting Chen

(57) ABSTRACT

A pneumatic pocket, manufactured by blow molding, has a top portion, a bottom portion, a pocket body connected between the top portion and the bottom portion, defining an air chamber therein, and a through hole communicating the air chamber and the outside. The pocket body has a responding portion and an assembly portion formed in the pocket body in a staggered manner. The responding portion allows the top portion to be deformed and telescoped towards the bottom portion for bearing an external force and driving the through hole to intake or discharge air in response. The assembly portion is configured to allow another pneumatic pocket to be positioned and assembled without interfering the deforming and telescoping of the responding portions thereof, so that the pneumatic pocket can be extended and expanded according to the size of a cushion body side by side, so that the pneumatic pockets can be arranged in the cushion body parallelly side-by-side.

12 Claims, 6 Drawing Sheets

PNEUMATIC POCKET AND APPLICATION THEREOF

BACKGROUND OF THE PRESENT INVENTION

Field of Invention

The present invention relates to a pneumatic pocket, and in particular, to the technical field of arranging a plurality of pneumatic pockets in a cushion body in a parallel and side-by-side manner.

Description of Related Arts

Nowadays, high-end cushion bodies for supporting and contacting human body, such as mattresses, pillows, seat cushions, and etc., usually contain a plurality of pockets mounted in a side-by-side manner inside the cushion body, so as for resiliently buffering and responding according to various curves of the human body that substantially provides a relatively comfortable texture.

According to the prior Taiwan Patent No. M575295 "Compression Cylinder Structure for Mattress Body" and Taiwan Patent No. M575296 "Structure of pad body" of the present inventor, specific technologies regarding mounting pneumatic pockets in a side-by-side manner inside a cushion body have revealed. These technologies really have the advantages of light weight and sensitive response, comparing with common and conventional technology of the spring pocket. Unfortunately, when the prior art pneumatic pockets are subjected to external force, they can be flipped or displaced easily. Therefore, how to ensure secure positioning of the pneumatic pockets inside the cushion body is highly relevant to its industrial utilization.

The prior patent M575295 mainly provides counter bores in the top pads and the bottom pads, so as for the pneumatic pockets to be aligned and positioned in a symmetrical top-and-bottom manner, preventing the pneumatic pockets from becoming flipped or displaced while being subjected to an external force. As for the prior patent M575296, the main body has corresponding hollowed-out portions for limiting the periphery of the pneumatic pockets in order to avoid flipping or displacing.

However, during the manufacturing, the present inventor discovered that the top pads, the bottom pads, and the main bodies according to the above mentioned prior patents have to be manufactured by using foaming materials. As a result, if large molds are utilized for production, the mold costs are relatively high, and it is also difficult to maintain the precision of the counter bores or the hollowed-out portions. Hence, the present inventor decides to make these aforementioned counter bores or hollowed-out areas independently through a cutting process. However, the processing of these large quantities of the counter bores or hollowed-out portions is very slow and inefficient, and that, according to current legal regulations, there will be additional processing costs for the wastes. As noticed, the overall manufacturing costs of the aforementioned patents are not economically beneficial.

Therefore, the present inventor, in view of the above drawbacks of the conventional technology, continuously conducting research for the improvement, has invented the present invention that meets the economic efficiency needs.

SUMMARY OF THE PRESENT INVENTION

A main object of the present invention is to provide a pneumatic pocket manufactured through blow molding, which pocket body has a responding portion and an assembly portion provided in a staggered manner. The responding portion allows a top portion to be deformed and telescoped towards a bottom portion for bearing an external force and driving an existed through hole to intake or discharge air in response. The assembly portion allows another pneumatic pocket to be positioned and assembled without interfering the deforming and telescoping of both responding portions thereof, so that the pneumatic pocket can be extended and expanded according to the size of the cushion body side-by-side, so that the pneumatic pockets can be arranged parallelly in the cushion body side-by-side. Therefore, when the cushion body is subjected to an external force, the pneumatic pockets can be sufficiently buffered and without becoming flipped or displaced. Accordingly, the pocket body can have responding portion and assembly portion arranged in a staggered manner, which can indeed improve the drawbacks of the above two prior patents, providing the present invention economic efficiency.

Another object of the present invention is to provide a cushion body, wherein the cushion body comprises a plurality of pneumatic pockets arranged and in a parallel and side-by-side manner and an outer layer unit covering and packing the pneumatic pockets. A pocket body of the pneumatic pocket has a responding portion and an assembly portion provided in a staggered manner. The responding portion allows a top portion to be deformed and telescoped towards a bottom portion for bearing an external force and driving an existed through hole to intake or discharge air in response. The assembly portion allows another pneumatic pocket to be positioned and assembled without interfering the deforming and telescoping of both responding portions thereof, so that the pneumatic pockets can be extended and expanded according to a size of the cushion body side-by-side, to be aligned parallelly in the cushion body side-by-side. Therefore, when the cushion body bears an external force, the pneumatic pockets can provide sufficiently buffer without becoming flipped or displaced and the manufacturing thereof can better achieve the economic object.

DETAILED DESCRIPTION OF THE PREFERRED EMBODIMENT

Figure 1:
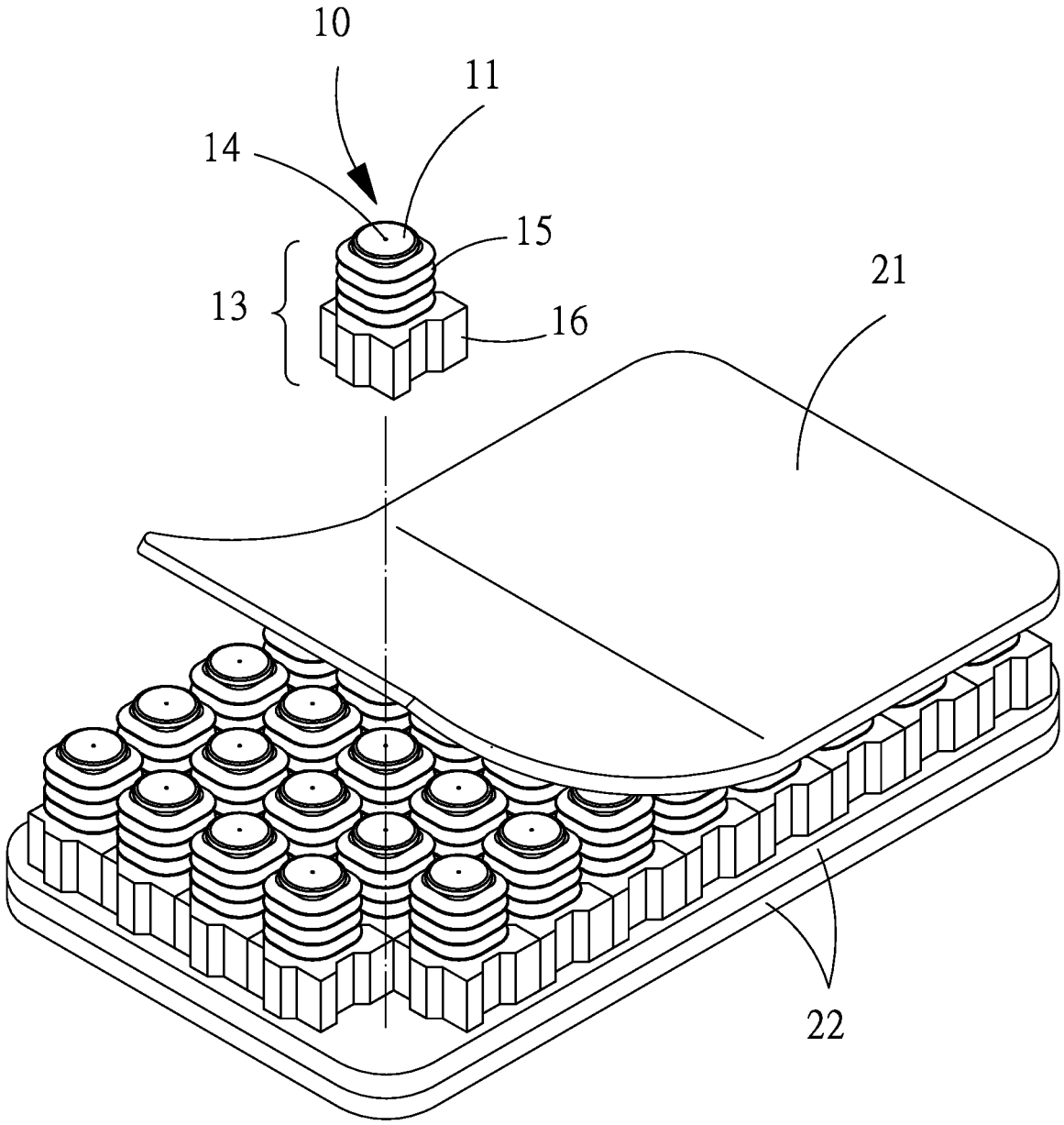
FIG. 1 is a perspective view illustrating positions of essential components of a cushion body before a cover thereof is sewn according to a preferred embodiment of the present invention.

The "cushion body" illustrated in the following embodiments may be embodied as a mattress, a pillow, a seat cushion, and etc., which, in other words, including all objects for supporting human body.

In order to completely illustrate the objects, features, and advantages of the present invention, the present invention is described in detail with reference to the following preferred embodiments with the accompanying drawings. Please refer to FIGS. 1-7, according to the present invention, the cushion body A comprises a plurality of pneumatic pockets 10 arranged in parallel and side-by-side manner, and an outer layer unit 20 for mounting the pneumatic pockets 10.

Figure 2:
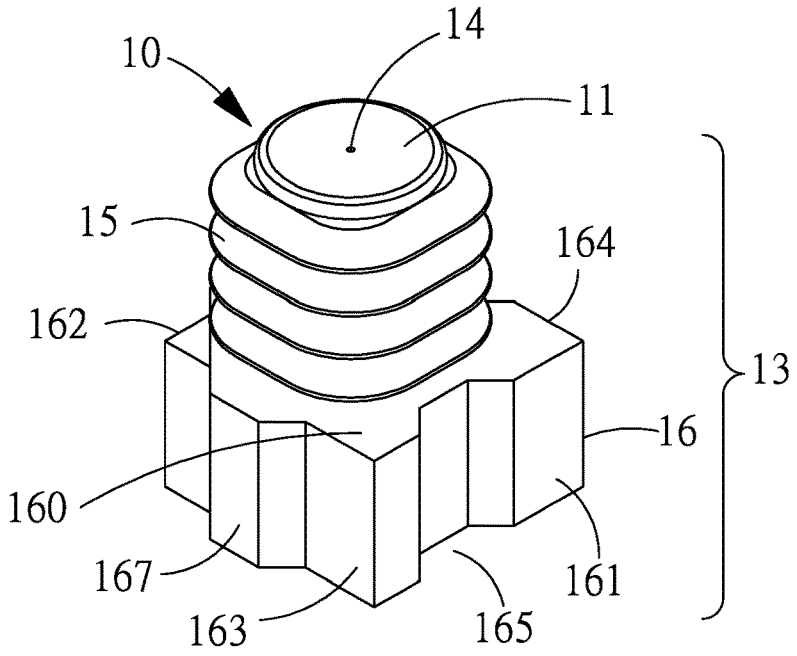
FIG. 2 is a perspective view of a pneumatic pocket according to the above preferred embodiment of the present invention.
Figure 3:
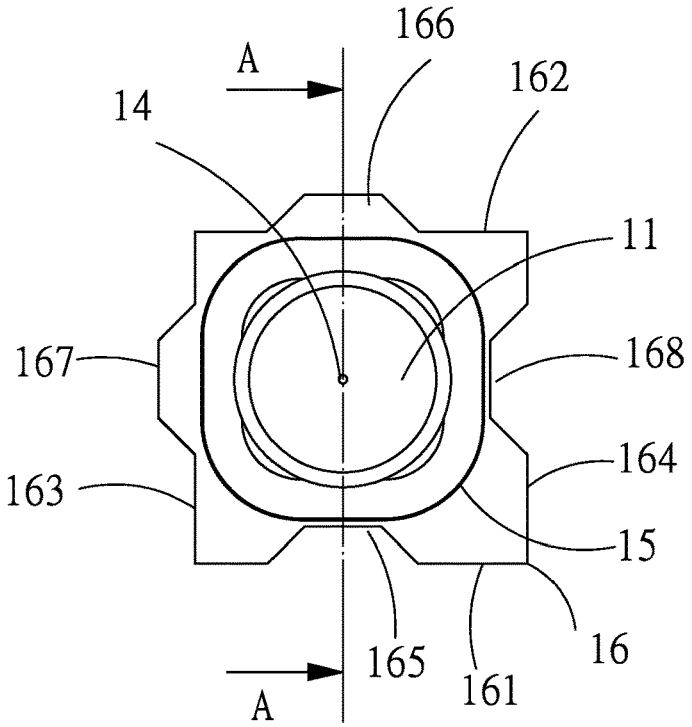
FIG. 3 is a top view of FIG. 2.
Figure 4:
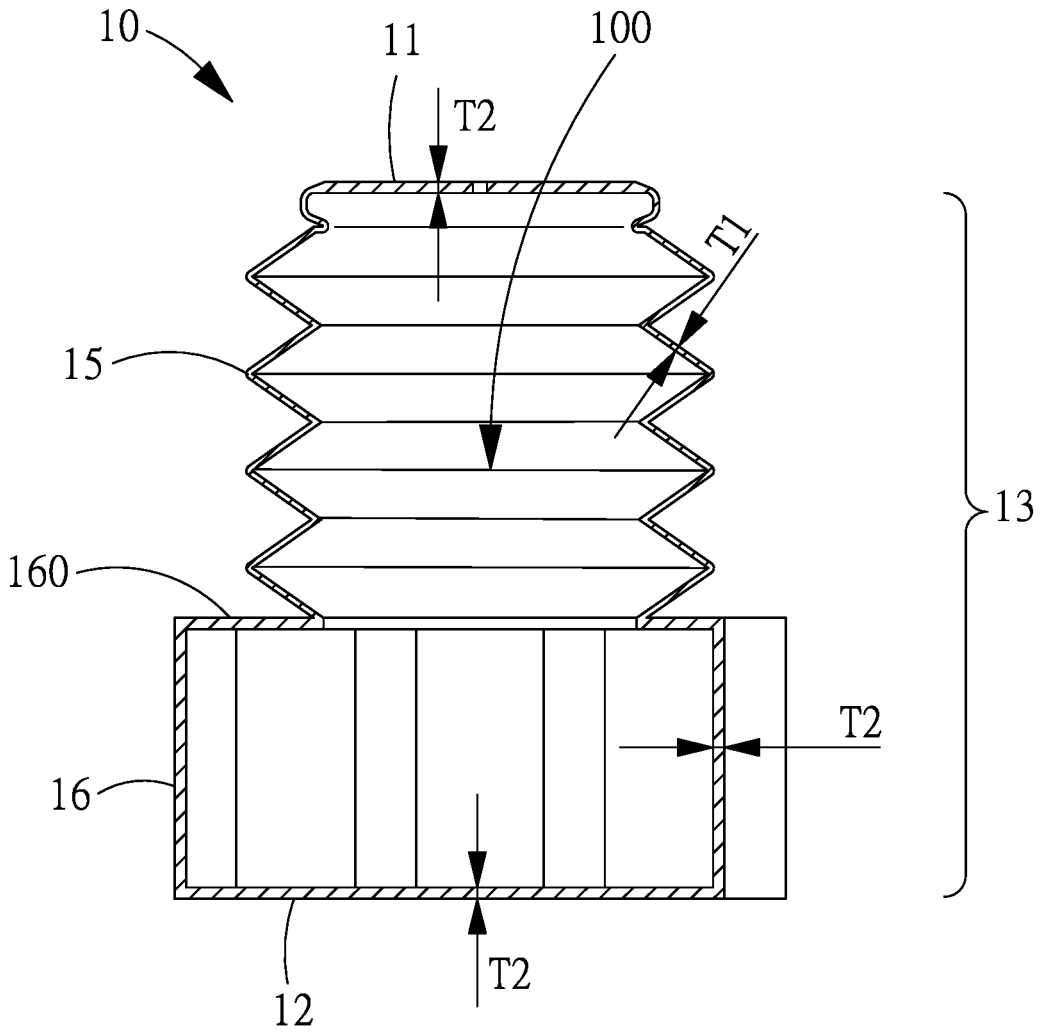
FIG. 4 is a sectional view of the A-A position of FIG. 3.
Figure 5:
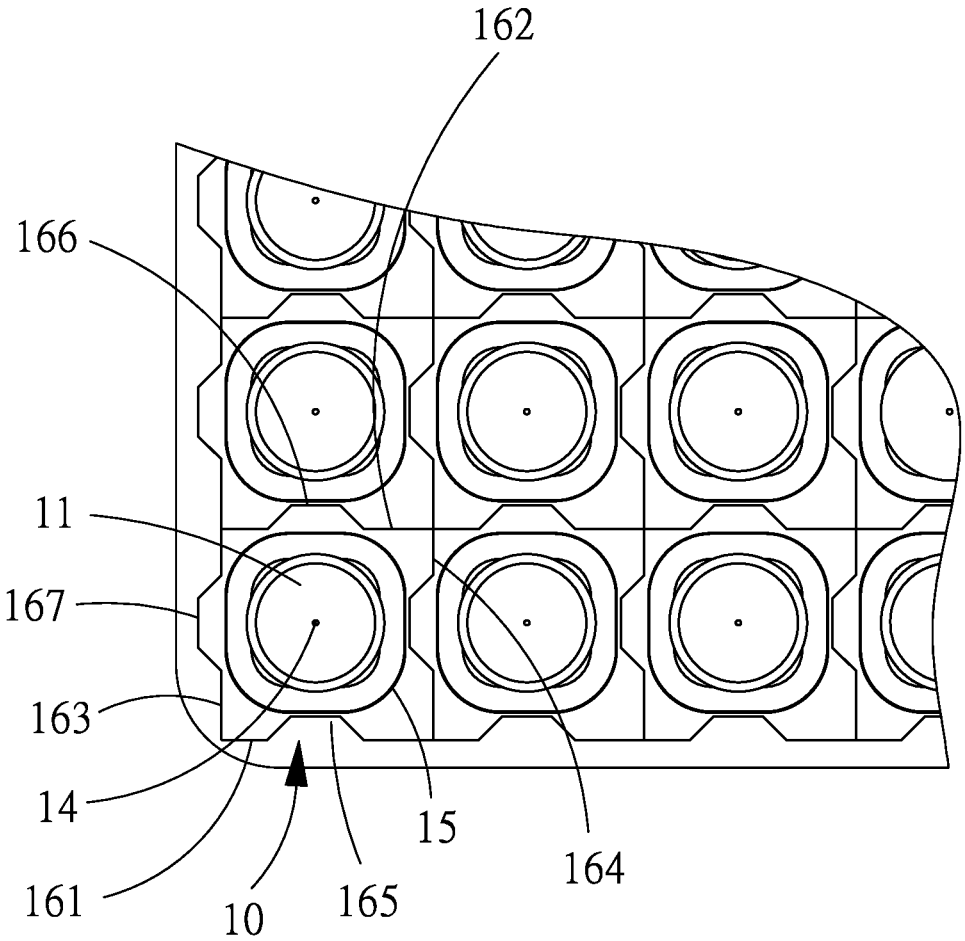
FIG. 5 is a top view of the pneumatic pockets aligned in a parallel and side-by-side manner according to the above preferred embodiment of the present invention.
Figure 6:
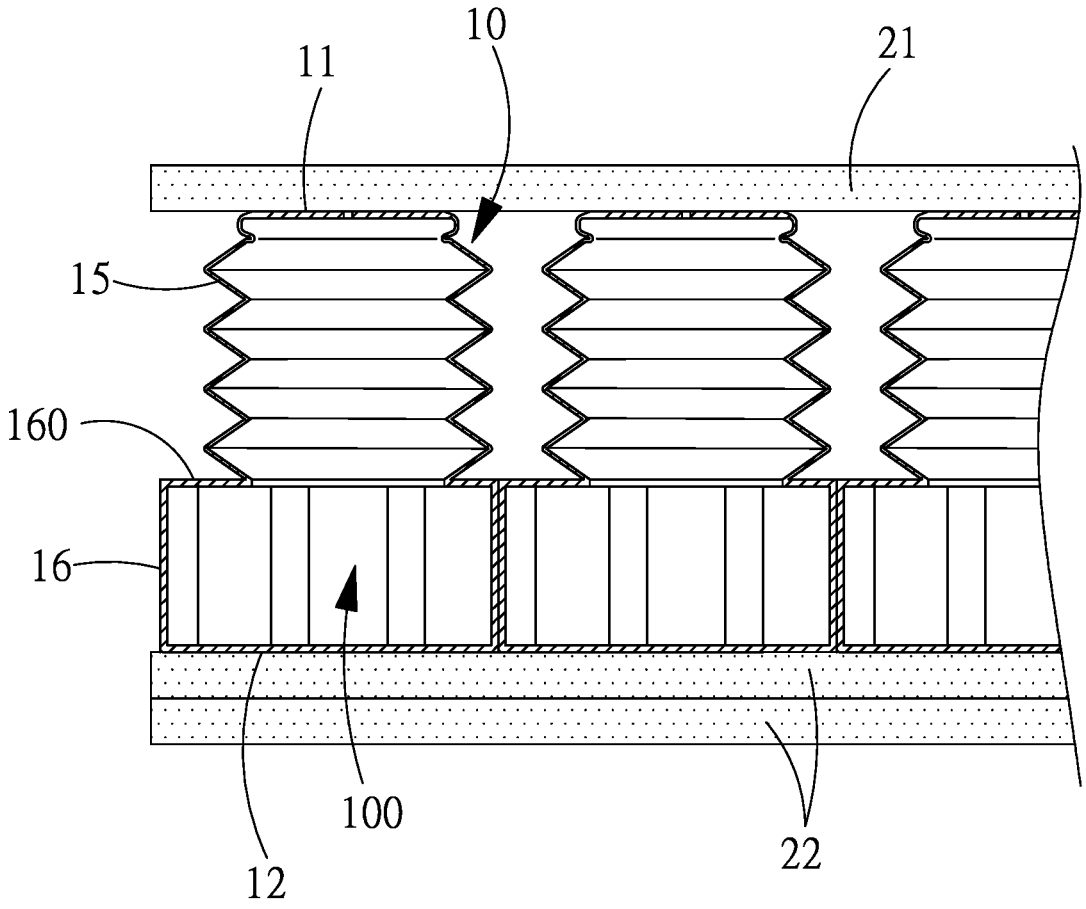
FIG. 6 is a sectional view of the FIG. 1.
Figure 7:
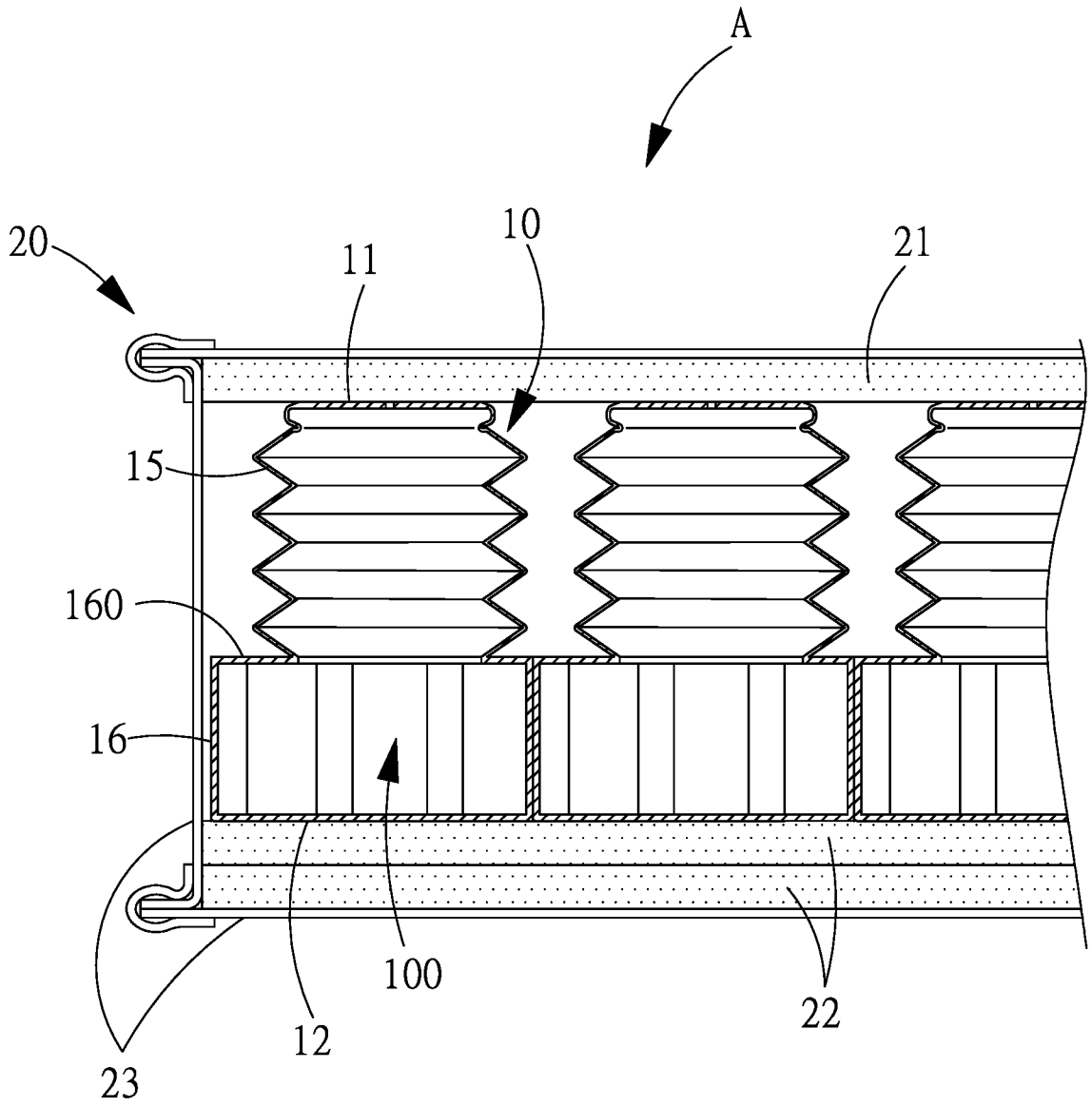
FIG. 7 is a sectional view illustrating the assembled cushion body with the cover thereof sewn according to the above preferred embodiment of the present invention.

The pneumatic pocket 10, which is made by blow molding, comprises:

a top portion 11 having a plate shape;

a bottom portion 12 having a plate shape;

a pocket body 13, connected between the top portion 11 and the bottom portion 12, defining an air chamber 100 therein;

at least one through hole 14, communicating the inside and outside of the air chamber 100, wherein FIG. 2 illustrates that the through hole 14 penetrates the top portion 11, but it may also be provided at the bottom portion 12 or an assembly portion 16 as mentioned below;

a responding portion 15, formed at an upper portion of the pocket body 13, which allows the top portion 11 to be deformed and telescoped towards the bottom portion 12 for bearing an external force and driving the through hole 14 to intake or discharge air in response, wherein the responding portion 15 is provided by forming a corrugated tube at a portion of the pocket body 13; and an assembly portion 16, formed at a lower portion of the pocket body 13, which allows another pneumatic pocket 10 to be positioned and assembled therewith. A wall thickness T2 of the assembly portion 16, the bottom portion 12 and the top portion 11 is greater than a wall thickness T1 of the responding portion 15, so that the assembly portion 16 has a better structure to bear external force. Besides, blow molding technology nowadays is capable of controlling the difference between the wall thicknesses T2 and T1 practically without any obsession. Further, the wall thickness T1 of the responding portion 15 may also be manufactured to be equal to the wall thickness T2 of the assembly portion 16 without sacrificing the deforming and telescoping capability of the responding portion 15. In addition, an outer diameter of the assembling area 16 is larger than an outer diameter of the responding portion 15, so as to form a radially expanded shoulder portion 160 at a portion of the assembly portion 16 adjacent to the responding portion 15, as illustrated in FIGS. 6 and 7. Then, the adjacent and assembled pneumatic pockets 10 bear an external force, the deforming and telescoping of the responding portions 15 thereof will not be interfered with each other. Furthermore, the outer diameter of the assembling area 16 may also be equal to the outer diameter of the responding portion 15 while the telescoping and deformation of the responding portion 15 will not be interfered. Referring to FIGS. 3 and 5, in order to allow the adjacent pneumatic pockets being fastly assembled parallelly side-by-side, according to the present invention, the assembly portion 16 is shaped in a square frame manner 161, so as to have a front side 161, a back side 162, a left side 163 and a right side 164 each having an equal length, wherein the front side 161 concavely has a first female locking element 165, while the back side 162 has a first male locking element 165 matched and engaged with the first female locking element 166, wherein the left side 163 has a second male locking element 166 symmetrical to the first male locking element 167, and the right side 164 has a second female locking element 168 matched and engaged with the second male locking element 167.

Referring to FIGS. 1, 6 and 7, the outer layer unit 20 comprises a top pad 21, a bottom pad 22 and a cover 23, wherein the top pad 21 and the bottom pad 22 are approximately the same in size as the cushion body A. A predetermined and appropriate number of pneumatic pockets 10 is arranged on the bottom pad 22 in parallel and side-by-side manner, preferably directly adhering on a top surface of the bottom pad 22, so as to ensure that the pneumatic pockets 10 and the bottom pad 22 are aligned and positioned with one another. Then, the top pad 21 is laid on the top portions 11 of the pneumatic pockets 10. Finally, the cover 23 is sewn along a periphery of the top pad 21 and the bottom pad 22, such that the finished product of the cushion body A, as illustrated in FIG. 7, is manufactured. In addition, the cover 23 and the assembly portions 16 of the adjacent pneumatic pockets 10 usually have some gaps therebetween. These gaps may be filled with some filler (not shown in the figures) so as to further affix the pneumatic pockets 10 in position.

It can be noted from the above description that the present invention has at least the following advantages:

First, the pneumatic pocket of the present invention is formed by blow molding, and both the responding portion and the assembly portion are integrally manufactured on the pocket body, so that, through the assembly portions thereof, two adjacent pneumatic pockets can be assembled in parallel and side-by-side manner inside the cushion body in order to obtain the required positioning. In addition, the assembly portion does not require additional manufacturing process to produce, so as to avoid the drawbacks of the requirement of extra cutting processes for making sinking holes or hollowed-out portions as in the prior technologies, and therefore, the present invention has improved on the economic benefit.

Second, the present invention allows an appropriate number of pneumatic pockets, depending on the size of the cushion body, to be arranged in parallel and side-by-side manner in the cushion body, so the application of the present invention is very wide.

Third, the assembly portion of the pneumatic pocket of the present invention adopts a square frame arrangement, wherein the front side and the back side respectively have a first female locking element and a first male locking element matched and engaged with each other, and the left side and the right side respectively have a second male locking element and a second female locking element matched with each other. Furthermore, the first male locking element and the second male locking element are symmetrical to each other, so as to allow turning the pneumatic pockets to match and engage the first female locking element with the first male locking element, or the second male locking element with the second female locking element, which happen to be close to each other, such that the assembling efficiency is effectively improved. Besides, this configuration allows the pneumatic pockets to extend and expand longitudinally and transversely, so that the pneumatic pockets can be selectively mounted for cushion bodies with different sizes.

In view of above, the overall structure and arrangement of the present invention are novel and advantageous that is certainly a great creation of a technical construct and a patentable subject matter. Also, what has been mentioned above is only one preferred embodiment of the present invention, which shall not be used to limit the scope of the practice of the present invention. In other words, all equivalent alternatives and modifications according to the description and claims of the present invention shall still be covered by the claimed scope of the present invention.

What is claimed is:

1. A pneumatic pocket, made through blow molding, comprising:

a top portion;

a bottom portion;

a pocket body, connected between said top portion and said bottom portion, defining an air chamber therein;

at least one through hole communicating with said air chamber;

a responding portion, formed at said pocket body, allowing said top portion to be deformed and telescoped towards said bottom portion for bearing an external force and driving said through hole to intake or discharge air in response; and an assembly portion, formed at said pocket body, being configured for positioning and assembling another pneumatic pocket thereto without interference of any deforming and telescoping of said responding portion, wherein said assembly portion, having a square frame shape, having a front side, a back side, a left side, and a right side each having an equal length, said front side having a first female locking element, said back side having a first male locking element being matched and engaged with said first female locking element, said left side having a second male locking element symmetrical to said first male locking element, said right side having a second female locking element being matched and engaged with said second male locking element.

2. The pneumatic pocket, as recited in claim 1 wherein an outer diameter of said assembly portion is greater than an outer diameter of said responding portion, so as to form a radially expanded shoulder portion at a portion of said assembly portion adjacent to said responding portion.

3. The pneumatic pocket, as recited in claim 1, wherein a thickness of a wall of said assembly portion is greater than a thickness of a wall of said responding portion.

4. The pneumatic pocket, as recited in claim 1, wherein a thickness of a wall of said assembly portion is greater than a thickness of a wall of said responding portion, and an outer diameter of said assembly portion is greater than an outer diameter of said responding portion, so as to form a radially expanded shoulder portion at a portion of said assembly portion adjacent to said responding portion.

5. The pneumatic pocket, as recited in claim 1, wherein said responding portion is formed at an upper portion of said pocket body and said assembly portion is formed at a lower portion of said pocket body.

6. The pneumatic pocket, as recited in claim 2, wherein said responding portion is formed at an upper portion of said pocket body and said assembly portion is formed at a lower portion of said pocket body.

7. The pneumatic pocket, as recited in claim 3, wherein said responding portion is formed at an upper portion of said pocket body and said assembly portion is formed at a lower portion of said pocket body.

8. The pneumatic pocket, as recited in claim 4, wherein said responding portion is formed at an upper portion of said pocket body and said assembly portion is formed at a lower portion of said pocket body.

9. A cushion body, comprising a plurality of pneumatic pockets arranged in parallel and side-by-side manner with each other, and an outer layer unit configured for mounting said pneumatic pockets therein, wherein each of said pneumatic pockets, manufactured by blow molding, has a top portion, a bottom portion, a pocket body, connected between said top portion and said bottom portion, defining an air chamber therein, and a through hole communicating said air chamber the outside, wherein said pocket body has a responding portion and an assembly portion provided in a staggered manner, wherein said responding portion allows said top portion to be deformed and telescoped towards said bottom portion for bearing an external force and driving said through hole to intake or discharge air in response, wherein said assembly portion is configured for allowing another said pneumatic pocket to be positioned and assembled without interfering any deforming and telescoping of said responding portions thereof, so as to allow each of said pneumatic pockets to be extended and expanded according to a size of said cushion body thereof, to be aligned parallelly side-by-side in said cushion body, wherein said assembly portion, having a square frame shape, has a front side, a back side, a left side, and a right side each having an equal length, wherein said front side has a first female locking element, said back side has a first male locking element matched and engaged with said first female locking element, said left side has a second male locking element symmetrical to said first male locking element, and said right side has a second female locking element matched and engaged with said second male locking element.

10. The cushion body, as recited in claim 9, wherein a thickness of a wall of said assembly portion is greater than a thickness of a wall of said responding portion, and an outer diameter of said assembly portion is greater than an outer diameter of said responding portion, so as to form a radially expanded shoulder portion at a portion of said assembly portion adjacent to said responding portion.

11. The cushion body, as recited in claim 9, further comprising an outer layer unit which comprises a top pad, a bottom pad and a cover, wherein a predetermined number of said pneumatic pockets is arranged on top surface of said bottom pad in parallel and side-by-side manner, wherein said top pad is laid on top of said pneumatic pockets, wherein said cover is sewn along a periphery of said top pad and said bottom pad.

12. The cushion body, as recited in claim 10, further comprising an outer layer unit which comprises a top pad, a bottom pad and a cover, wherein a predetermined number of said pneumatic pockets is arranged on top surface of said bottom pad in parallel and side-by-side manner, wherein said top pad is laid on top of said pneumatic pockets, wherein said cover is sewn along a periphery of said top pad and said bottom pad.

* * * * *